United States Patent [19]

Jackson

[11] Patent Number: 4,834,385

[45] Date of Patent: May 30, 1989

[54] RANDOM BALL SELECTOR APPARATUS

[76] Inventor: Gary L. Jackson, 5206 Lippincott Blvd., Burton, Mich. 48519

[21] Appl. No.: 138,831

[22] Filed: Dec. 28, 1987

[51] Int. Cl.[4] ..... A63F 9/00

[52] U.S. Cl. ..... 273/144 A

[58] Field of Search ..... 273/144 R, 144 A, 144 B; 220/252

[56] References Cited

U.S. PATENT DOCUMENTS

| | | | |
|---|---|---|---|
| 1,029,321 | 6/1912 | Schaffer | 220/252 |
| 2,003,979 | 6/1935 | Skoric | 273/144 A |
| 2,555,132 | 5/1951 | Hickey | 273/144 A X |

FOREIGN PATENT DOCUMENTS

| | | | |
|---|---|---|---|
| 121801 | 12/1918 | United Kingdom | 273/144 B |

*Primary Examiner*—Anton O. Oechsle

*Attorney, Agent, or Firm*—Leon Gilden

[57] ABSTRACT

A stationary drum includes a first sliding door for providing access of entry for a plurality of balls to be introduced into said drum. A second sliding door is repositionable to allow removal by action of gravity of a plural series of said balls after agitation of said balls by a plurality of rotatable paddles. A plural series of chutes are available to enable acceptance of the released series of balls whereupon said balls are individually and selectively removable.

5 Claims, 1 Drawing Sheet

RANDOM BALL SELECTOR APPARATUS

BACKGROUND OF THE INVENTION

1. Field of the Invention

The present invention relates to random ball selection devices, and more particularly pertains to a new and improved random ball selection device which enables introduction of a finite series of balls, the rotatable mixing of said balls, and finally the removal of a desired number of said balls from the mixing forum for yielding a random selection of said balls.

2. Description of the Prior Art

The use of random ball selection devices is well known in the prior art. As may be appreciated, these devices have normally required a substantial amount of complexity to enable and insure the appropriate random selection of such balls. The economy of manufacture and design as well as producing an effective random selection for use in such gaming devices as a lottery or the like has been a limiting factor in development of such devices. For example, U.S. Pat. No. 4,403,775 to Chaput provides a dual compartment random ball selector wherein a first compartment enables manual shaking of the balls therein. Balls of a plurality of colors are utilized wherein upon repositioning the balls in a second compartment overlying a series of numbers, certain of the numbers correspond to certain of a second color of balls to thereby randomly select the balls. The device does not lend itself readily to appropriate mixing and furthermore is limiting in number and selection of balls to achieve an appropriate random ball selection.

U.S. Pat. No. 4,497,486 to Bennett is another random ball selection device wherein a plurality of balls are merely housed within a transparent cell and where the entire cell is manually shaken to enable the balls to dispose themselves over preselected depressions within the floor of the cell and thereby select numbers positioned about the floor of the cell.

U.S. Pat. No. 4,533,143 to Albright utilizes a portable hand held apparatus for selecting a plurality of numbers. A plurality of cubes are contained a fluid-tight opaque container whereupon agitation of the container by a user enables the cubes therein to readily come to rest adjacent a viewing window and provide selection of numbers thereby.

U.S. Pat. No. 4,545,578 to Stagg is another device for randomly selecting numbers wherein it provides a series of recesses for ball positionable therein whereupon the dropping of the device onto a surface enables the balls to reposition themselves onto random numbers.

U.S. Pat. No. 4,601,471 to Frank utilized fluid flow to agitate balls for random selection. Balls are agitated at various levels and ostensively a true random selection will be provided. The Frank device is quite removed from Applicant's improved random ball selection technique.

British Pat. No. 853,887 to Antrobus sets forth a pocket random ball device and in a manner similar to other devices of this class utilizes manual shaking or manipulation of the container to provide random ball selection.

As such, it may be appreciated that there is a continuing need for a new and improved random ball selection device which addresses both the problem of efficiency of ball manipulation and effectiveness of ball withdrawal subsequent to manipulation to present an appropriate and desired number of random balls. In this respect, the present invention substantially fulfills this need.

SUMMARY OF THE INVENTION

In view of the foregoing disadvantages inherent in the known types of random ball selection devices now present in the prior art, the present invention provides an random ball selector apparatus wherein the same enables efficient and effective random ball mixing and extraction on a selective basis and further enables any pre-selected number of digits to be withdrawn. As such, the general purpose of the present invention, which will be described subsequently in greater detail, is to provide a new and improved random ball selector apparatus which has all the advantages of the prior art random ball selection devices and none of the disadvantages.

To attain this, the present invention comprises a stationary drum including a plurality of slidable doors about the surface wherein a first slidable door is rotatable to accommodate a series of balls to be introduced within the drum and after appropriate mixing within the drum, a second door is repositionable to enable introduction of a pre-selected number of balls into appropriate chutes where each chute is provided with a plurality of outlets selectively openable to enable removal of a pre-selected number of balls and thereby digits for a desired random number.

My invnetion resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is of enable the U.S. Patent and Trademark Office and the public generally, and especially the scientists, engineers and practitioners in the art who are not familiar with patent or legal terms or phraseolgy, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved random ball selector apparatus which has all the advantages of the prior art random ball selector apparatus and none of the disadvantages.

It is another object of the present invention to provide a new and improved random ball selector apparatus which may be easily and efficiently manufactured and marketed.

It is a further object of the present invention to provide a new and improved random ball selector apparatus which is of a durable and reliable construction.

An even further object of the present invention is to provide a new and improved random ball selector apparatus which is susceptible of a low cost of manufacture with regard to both materials and labor, and which accordingly is then susceptible of low prices of sale to the consuming public, thereby making such random ball selector apparatus economically available to the buying public. provide a new and improved random ball selector apparatus which provides in the apparatuses and methods of the prior art some of the advantages thereof, while simultaneously overcoming some of the disadvantages normally associated therewith.

Still another object of the present invention is to provide a new and improved random ball selector apparatus wherein a rotatable drum includes a plurality of slidable doors formed on the surface of the drum to enable initial introduction of a series of balls into the drum for mixing and subsequent removal of said balls into accepting chutes.

Yet another object of the present invention is to provide a new and improved random ball selector apparatus wherein accepting chutes to accommodate a pre-selected number of balls are formed with selectively doors to enable withdrawal of a pre-selected series or number of balls.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
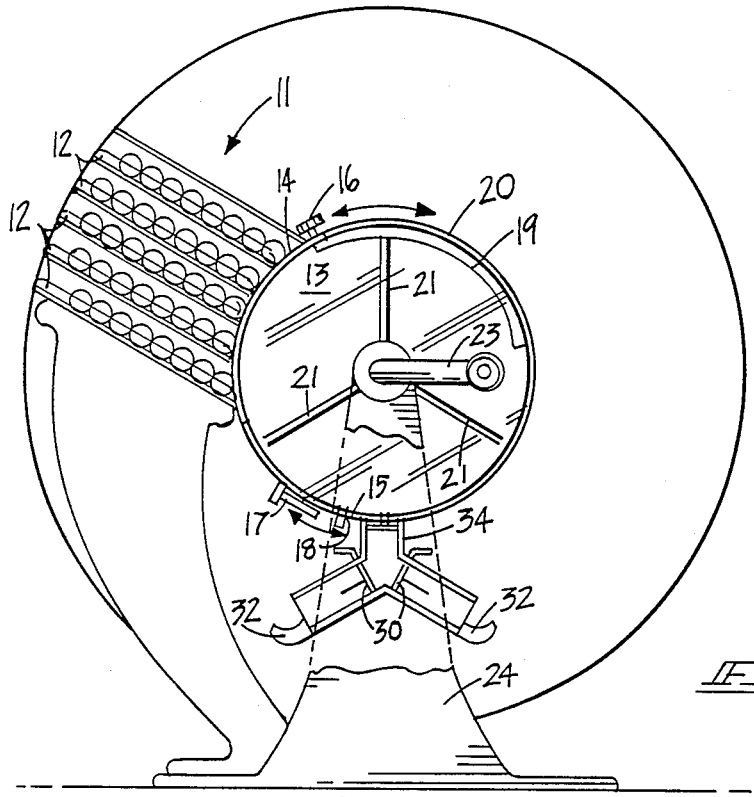
FIG. 1 is a side orthographic view of the instant invention.
Figure 3:
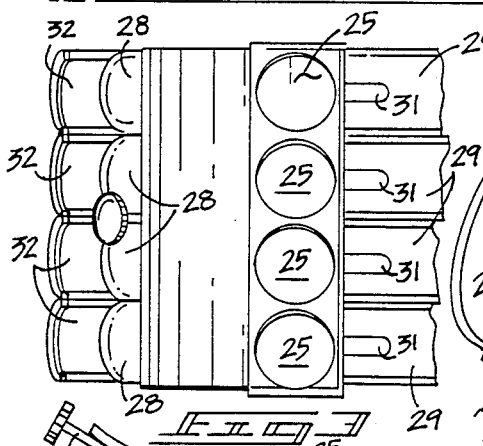
FIG. 3 is a top orthographic view illustrating the exit opening and underlying chutes for acceptance of random balls.
Figure 2:
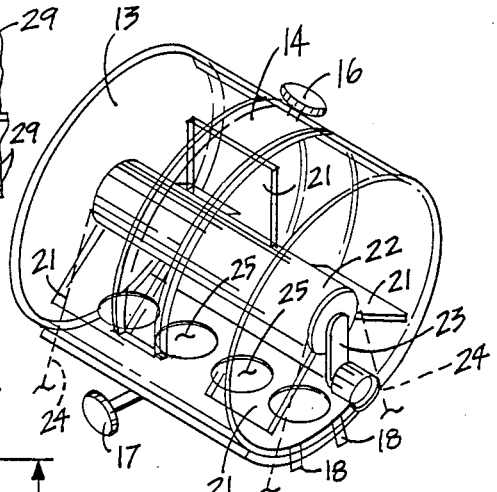
FIG. 2 is an isometric view of the drum of the instant invention.

With reference now to the drawings, and in particular to FIGS. 1 and 2 thereof, a new and improved random ball selector apparatus embodying the principles and concepts of the present invention and generally designated by the reference numeral 10 will be described.

More specifically, it will be noted that the random ball selector apparatus 10 essentially comprises a stationary drum 13 positioned to accept balls positioned within a ball array 11. The ball array 11 has formed therein a plural series of numbered balls in a pre-selected enumeration. The racks 12 have guard rails associated therewith to prevent the balls from being displaced from the racks and said rails may be of any configuration or the ball array 11 may be formed as a plurality of chutes positioned and disposed proximate drum 13 to enable feed of balls to said drum. A first relatively narrow door 14 of a length equaling the circumferential extent of ball array 11 about drum 13 and of width substantially equal to that of the balls to be introduced. Door 13 is reciprocatably positionable, as indicated by the arrow, along the circumference of drum 13 within a guideway opening 20 overlying a guard plate 19 such that when door 14 is displaced to enable entry of the balls and ball racks 12, to occupy guideway opening 20, it will slidingly ride over guard plate 19 and when door 14 is returned to its original position, as illustrated, guard 19 prevents escape of balls through guideway opening 20. Conventionally, door 14 may be slidable by means of a tongue and groove arrangement between the door 14 and stationary drum 13. An underlying second door of a length substantially that of the axial length of drum 13 is secured by means of guideways 18 and manipulatable by a second door handle 17 wherein first narrow door 14 is manipulatable by handle 16, essentially as illustrated.

Secured within drum 13 are a series of gapped paddles 21 for mixing of balls disposed therein wherein said gapped paddles are fixed to a central axle 22 and rotatable by a rotating handle 23. A pair of stanchions 24 secure and orient the stationary drum 13 relative to a base or floor positioning, as illustrated in FIGS. 1 and 2, but any convenient mounting means may be utilized to merely orient the drum 13 in a horizontal orientation relative to a base.

Formed in the lowermost portion of drum 13 proximate sliding door 15 are a series of openings 25 formed within lowermost portion of drum 13 enabling the dropping, by action of gravity, of a number of pre-selected balls therethrough after adequate mixing by the aforenoted gapped paddles 21.

Figure 4:
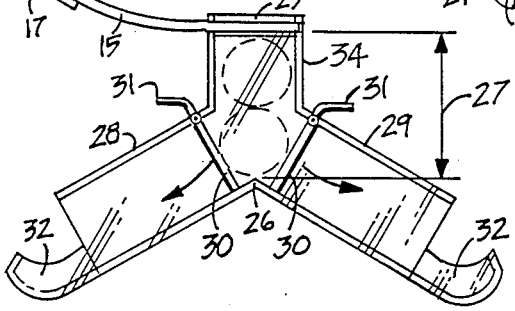
FIG. 4 is a side orthographic view of the invention as illustrated in FIG. 3.

A plurality of upper chutes 34 are disposed proximate openings 25 whereupon repositioning of door 15, balls will pass through openings 25 into upper chutes 34 wherein a like number of upper chutes 34 correspond to a like number of openings 25. The chutes 34 underlying openings 25 enable a plurality of balls to drop therethrough wherein their dimension 27 indicated by the arrow is of a height to substantially equal that of two balls, as the balls align over the "Y" section 26. It should be noted that the illustrations in FIG. 4 is similar for all four chutes and for purposes of illustration is deemed to be adequate. Thusly a ball will be positioned in contact with each door 30 formed within the respective chutes 28 and 29 and upon manipulation of handle 31, the door may be positioned to enable balls to pass therethrough and to catch within troughs 32 depending outwardly from the various chutes to enable manual grasping of balls secured therein.

In use therefore, the door 14 is shifted clockwise illustrated in FIG. 1, by means of handle 16 traversing over the guard plate 19 within guideway opening 20 enabling the randomly numbered balls secured within racks 12 to enter stationary drum 13 whereupon door 14 is returned to the original position. Thereupon, handle 23 is rotatable to enable the gapped paddles 21 to rotate and mix the balls within the drum. After adequate mixing has occurred, door 15 is rotated clockwise by means of handle 17 enabling pre-selected number of balls to drop through openings 25. Only two balls per chute 34 will drop due to the height and volume of each chute 34 enabling a total eight balls to fall through four openings 25 into the four chutes 34. Second door 15 is then returned to its original position to prevent any further balls from passing into chutes 34 subsequent to opening of doors 30 enabling the balls to present themselves to the eight trough portions 32. Each door 30 is individually pivotal outwardly of chutes 28 and 29 to enable a user to remove whatever number of balls, in this case from 0 to 8 is desired. It may be understood that a greater or lesser number of chutes may be positioned with according openings 25 to enable a lesser or greater number of balls to be removed dependent upon the desired number of digits to be selected. Alternatively, door 15 may once again be opened to present another charge of balls to present themselves within chutes 34. Doors 30 are pivotally secured within the various chutes 28 and 29 in any desired number of mechanical means.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A random ball selector apparatus for the random selection of numbers comprising, a stationary cylinder-shaped container means formed with a first slidable entrance door and a second slidable exit door, and a random ball array support means for support of a plurality of enumerated balls positioned proximate said first door for entering said container means upon arcuate re-positioning of said first door, and rotatable agitating means to randomly agitate said balls, said second door repositionable to enable gravity motivated withdrawal of a random plurality of balls, and chute means underlying said second door for securing said balls for subsequent manual removal therefrom, and wherein said first door is slidable within the surface of the cylinder and displaceable over an underlying guard plate into a guideway opening overlying said guard plate arcuately displaced from said ball array support means to enable said balls supported within said support means to enter said stationary cylinder, and wherein said chute means includes a vertically oriented upper chute opening downwardly into a plurality of lower chutes for acceptance of balls withdrawn from said stationary cylinder by means of gravity.

2. A random ball selector apparatus as set forth in claim 1 wherein said lower chutes are selectively blocked by pivotal doors, said doors being pivotally displaceable to enable repositioning of said balls for manual removal.

3. A random ball selector apparatus as set forth in claim 2 wherein said stationary cylinder includes a plurality of exit openings to equal the number of upper chutes wherein said exit openings are in overlying relationship to said upper chutes whereupon displacement of said second door enables dropping of said balls from sid stationary cylinder into said upper chutes.

4. A random ball selector apparatus as set forth in claim 3 wherein said agitating means includes a plurality of gapped paddles radially extending and integrally secured to a central rotatably mounted axle coextensive with the axis of said stationary cylinder and rotatable by means of a handle portion positioned externally of said stationary cylinder.

5. A random ball selector apparatus as set forth in claim 4 wherein said gapped paddles are discontinuously formed along said axle to enable said balls to reposition themselves therethrough for enabling thorough mixing of said balls.

* * * * *